US005370368A

United States Patent [19]

Terrels et al.

[11] Patent Number: 5,370,368

[45] Date of Patent: Dec. 6, 1994

[54] HANDRAIL ASSEMBLY

[76] Inventors: Andrew P. Terrels, 1324 Central Ave., Ocean City, N.J. 08226; Edward L. Myers, Jr., 1106 Earle Ave., Milville, N.J. 08332

[21] Appl. No.: 83,617

[22] Filed: Jun. 28, 1993

[51] Int. Cl.[5] ..... E04H 17/14

[52] U.S. Cl. ..... 256/19; 256/65; 256/66; 256/68

[58] Field of Search ..... 256/19, 65, 66, 68

[56] References Cited

U.S. PATENT DOCUMENTS

| | | | |
|---|---|---|---|
| 340,263 | 4/1886 | Weber | 256/68 |
| 760,882 | 5/1904 | Litzinger | 256/66 |
| 2,834,621 | 5/1958 | Schroer | 256/65 |
| 2,930,638 | 3/1960 | Morrissey | 256/65 |
| 2,999,671 | 9/1961 | Blayden | 256/65 |
| 3,490,063 | 1/1970 | Romney | 403/235 |
| 3,580,620 | 5/1971 | Offenbroich | 403/239 |
| 3,787,033 | 1/1974 | Snyder et al. | 256/65 |
| 3,804,542 | 4/1974 | Hammerschmidt | 256/65 |
| 3,810,341 | 5/1974 | Holz | 248/296 |
| 4,053,140 | 10/1977 | Clemens et al. | 256/66 |
| 4,238,117 | 12/1980 | Newman | 256/65 |
| 4,383,676 | 5/1983 | Souza, Jr. | 256/65 |
| 4,403,767 | 9/1983 | Basey | 256/66 |
| 4,461,461 | 7/1984 | Caron | 256/65 |
| 4,610,432 | 9/1986 | Lewis et al. | 256/65 |
| 4,722,514 | 2/1988 | Pettit | 256/66 |
| 4,892,292 | 1/1990 | Russell | 256/66 |
| 4,930,754 | 6/1990 | Caron et al. | 256/65 |
| 4,952,092 | 8/1990 | Ballerstein | 256/65 |
| 5,261,647 | 11/1993 | Venegas, Jr. et al. | 256/66 |

FOREIGN PATENT DOCUMENTS

| | | | |
|---|---|---|---|
| 858170 | 12/1970 | Canada | 256/65 |
| 3404947 | 8/1985 | Germany | 256/65 |
| 304896 | 1/1929 | United Kingdom | 256/65 |
| 683386 | 11/1952 | United Kingdom | 256/65 |

*Primary Examiner*—Richard A. Bertsch
*Assistant Examiner*—Howard R. Richman
*Attorney, Agent, or Firm*—Dann, Dorfman, Herrell and Skillman

[57] ABSTRACT

A handrail assembly having seamless joints. The exposed components of the handrail are lengths of thick-walled plastic pipe and selected components have a metallic liner. The plastic pipes are joined to one another at any desired angle with the use of an alignment stud. The alignment stud has one end formed as a saddle at the desired angle to its axis and is attached to the one component by a threaded fastener passing through the stud. The hollow cylindrical saddle of the stud bears against the outside of the plastic pipe of the one component and is held in tight engagement against the pipe by the threaded fastener. The plastic pipe of the other component is likewise formed with a hollow cylindrical saddle adapted to mate with the outside surface of the first component and is telescopically engaged over the fastened stud and is anchored in place by a set screw passing through the plastic pipe into the stud. The head of the set screw is concealed by a plug. The exposed surface of the plug and the surrounding surface of the plastic pipe are sanded and polished so as to conceal the plug.

15 Claims, 4 Drawing Sheets

HANDRAIL ASSEMBLY

FIELD OF THE INVENTION

The present invention relates to railing assemblies and has particular application to railings for sidewalks and outdoor platforms which are exposed to the weather and must be resistant to a wide range of weather conditions. The invention is particularly applicable to a novel joint for railing assemblies formed of thick walled plastic pipe which is commonly used at the seashore.

BACKGROUND OF THE INVENTION

Railings formed of plastic pipe have been popular along the seashore because of the resistance of the plastic pipe to corrosive effects of the salt air. Plastic pipes may be assembled by using the normal T-fittings and elbows which are widely available. To prevent warping or misalignment of the joints and to provide additional strength, metal liners have been provided to fit within the bore of the plastic pipe and reinforcing plugs have been installed in the joints to resist separation and to provide strength to compensate for the weakness which would otherwise be present in the joints.

The usual pipe fittings for plastic pipes are not designed for aesthetics and several attempts have been made to improve the aesthetics of the railings by modifying the normal fittings. One technique is to make the fittings of an outside diameter corresponding to the outside diameter of the plastic pipe and to provide a rabbeted joint to connect the fittings to the rails. The counterboring of the ends of the rails and/or fittings to provide the rabbeted joint tends to weaken the joint and requires the use of a reinforcing element. Furthermore, the seam at the rabbeted joint can be unsightly and to improve its appearance would require a skilled operator to weld the seam so as to minimize its unsightliness.

It is not uncommon for railings to become damaged after installation and with the existing railing assemblies, the removal and replacement of a damaged rail section entails replacement of the entire section of the railing and to avoid unsightly appearances at the areas where the section has been replaced, it is frequently preferable to replace the entire assembly.

SUMMARY OF THE INVENTION

With the foregoing in mind, the present invention provides a novel rail assembly which may be installed by relatively unskilled operators and may still preserve the appearance of a seamless assembly.

Another object of the present is to provide an assembly which facilitates replacement of damaged elements by enabling the damaged element to be removed from the assembly without damaging the remaining components of the assembly.

More specifically, the present invention provides an assembly wherein the components are mechanically secured to one another to form a joint without welding, but in which the joints produced are seamless.

Specifically, the present invention provides an assembly in which one component of plastic pipe is assembled to another component of plastic pipe by the use of joint-supporting alignment studs secured to one of the components and fitted within the bore of the other component. The stud is anchored in the other component after assembly by a set screw which is concealed by covering the head thereof.

BRIEF DESCRIPTION OF THE DRAWINGS

All of the objects of the invention are more fully set forth herein with reference to the accompanying drawing, wherein.

DESCRIPTION OF THE PREFERRED EMBODIMENTS

Figure 1:
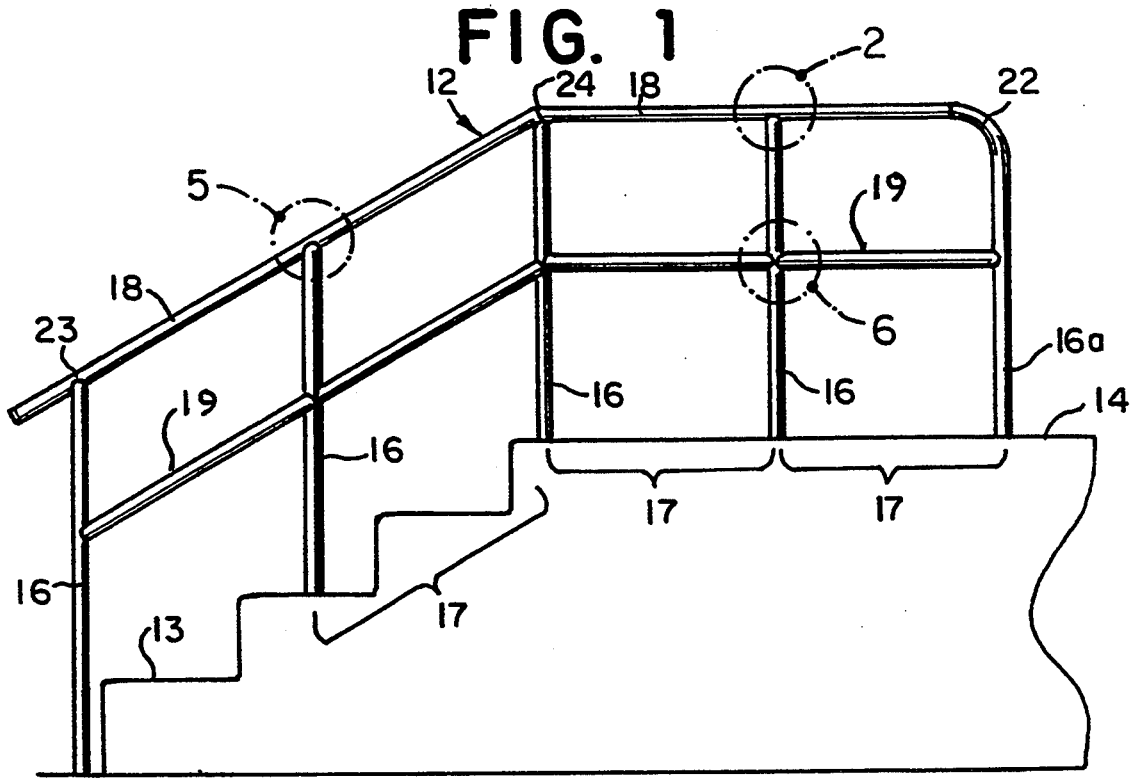
FIG. 1 is a view of a handrail assembly embodying preferred embodiments of the present invention.

With reference to FIG. 1, a handrail assembly, designated by the general reference numeral 12 is mounted on a set of steps 13 leading to a platform 14. The handrail assembly includes a series of upright posts 16. Between adjacent posts a rail section 17 is mounted, and in the present instance, the rail section comprises a top rail 18 and an auxiliary rail 19 positioned approximately mid way between the top rail and the bottom of the posts of the section. The top rails 18 of each section combine to form a continuous handrail extending along the top of the posts 16 generally parallel to the platform 14 at the top and parallel to the incline of the steps 13 over the steps.

The connections at the ends of the top rail may be made in numerous ways which are not deemed to be part of the present invention. At one end 22 of the top handrail, the top rail 18 merges into the terminal post 16*a*. In the assembly illustrated in FIG. 1, top rail 18 merges into the post 16*a* through an elbow 22 formed at the upper end of the post with a telescoping joint which preferably is rabbeted to provide a smooth merger of the top rail 18 into the post 16*a*. A rabbeted joint is particularly suited for installations which are made by unskilled workers, such as homeowners, since a rabbeted joint may be solvent-welded or glued by an unskilled worker with minimal appearance of a seam. The seam may be further masked by sanding and polishing the seam line so that it is substantially invisible. A simple butt joint may be used where a skilled operator is available to heat-weld the abutted plastic pipe end to form a seamless connection. At the opposite end 23 of the top rail at the left of FIG. 1, the rail 18 is extended beyond the post 16 and its end is terminated by a plug. At the top of the steps, the respective ends of the top rail sections 18 are beveled and interconnected to provide an angular connection as indicated at 24.

The present invention provides a novel connection between the intermediate posts 16 and the top rail 18 and between the auxiliary rails 19 and the posts 16. The present invention provides a connection which is virtually seamless and may be finished so as to conceal the existence of extraneous fasteners and eliminate the need for weldments which demand the attention of relatively highly skilled operators to achieve the desired seamless appearance.

Preferably, the railing components are formed with a thick-walled plastic outer pipe or tubing 25, for example a vinyl pipe having a two-inch outer diameter with a 5/16" wall thickness. The vertical posts 16 have a metallic tubular liner 26 which terminates short of the top of the post to enable the post to be connected to the top rail, either as described above or else by the novel joint described hereinafter. The metal liner is preferably a Schedule 40 galvanized steel tube having a 1-5/16" OD fitted within the cylindrical bore of the thick wall plastic pipe. The top rail is likewise formed of a thick wall plastic pipe 28 having a metallic liner 29 extending for a substantial part of its length. The auxiliary rail may be plastic tubing provided with a metallic liner or without, as desired or specified.

For handrail installations, it is preferred to use a metal-lined plastic pipe for the top rail 18, and to use unlined plastic pipe for the auxiliary rail 19. In the top rail, the metal lining extends throughout its length. At a splice, the lining terminates an inch or two before the end of one tubular length and extends a similar, but shorter, distance beyond the end of the other length so as to permit splicing of the two lengths, end-to-end, with the extension of the liner serving to align and reinforce the joint. Likewise, the vertical post has its metal liner 26 terminating below the top of the post to permit the insertion of an aligner stud into the tubular end of the thick wall plastic pipe as discussed hereinafter. The liner is preferably of a hard metal which is capable of being drilled and tapped to provide a firm seat for receiving a fastener such as a machine bolt at the joint, e.g. Schedule 40 galvanized steel pipe.

Figure 2:
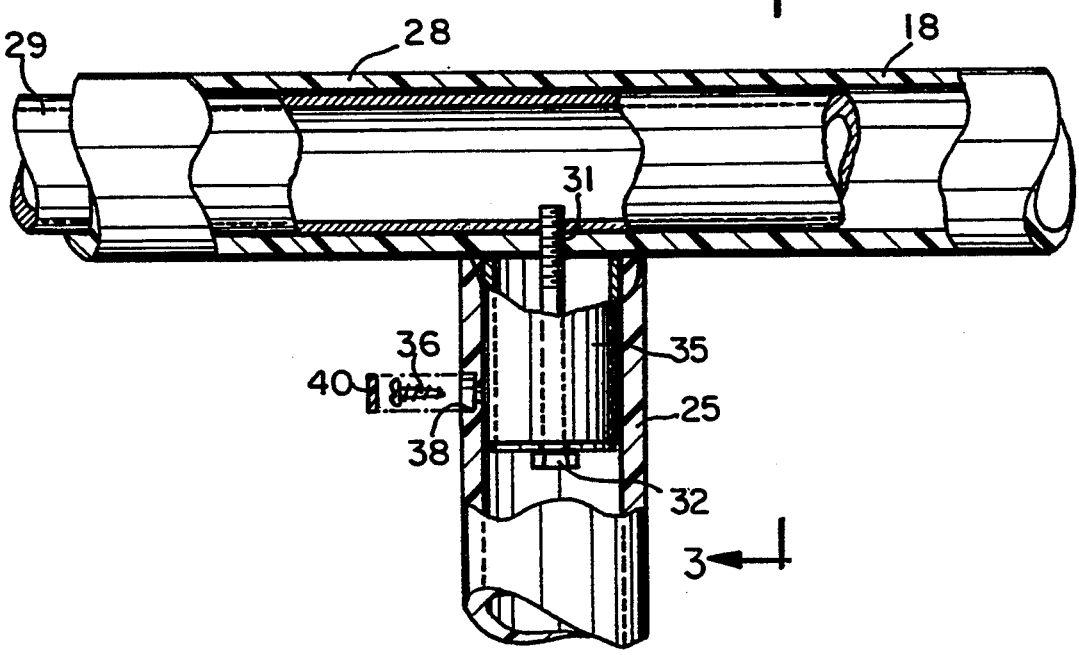
FIG. 2 is an enlarged elevational view with portions broken away illustrating a joint encircled at 2 in FIG. 1.
Figure 4:
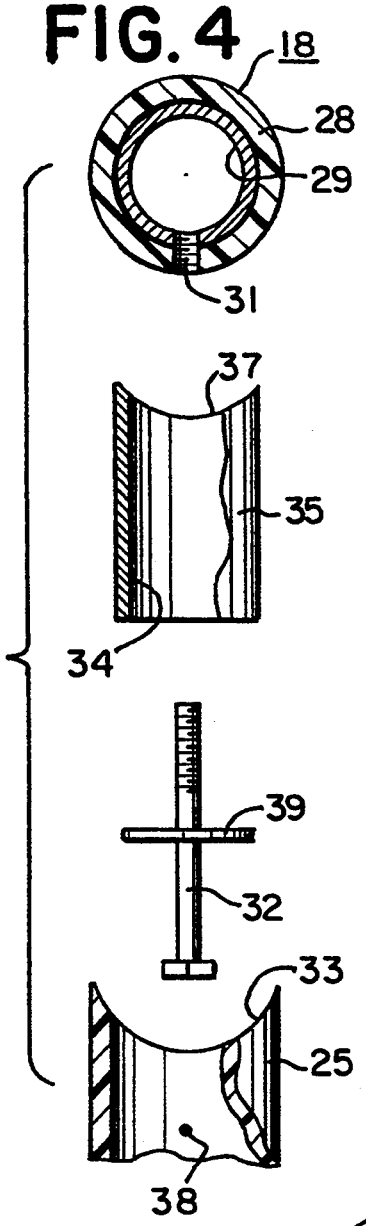
FIG. 4 is an exploded view of the components shown in FIG. 3 illustrating their assembly.
Figure 3:
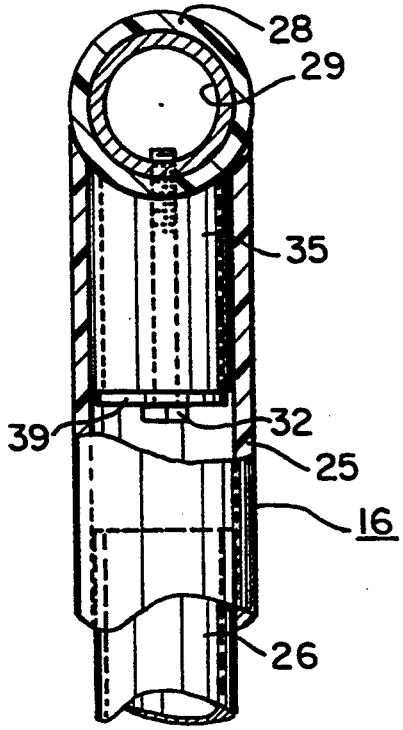
FIG. 3 is a sectional view taken on the line 3—3 of FIG. 2.

In accordance with the present invention, the auxiliary rails are connected to the posts with a seamless joint, and the posts are connected to the top handrails with a similar seamless joint. Referring to FIG. 1, a joint between the vertical post 16 and the horizontal handrail 18 is illustrated in FIGS. 2, 3 and 4. As best shown in FIG. 4, the handrail 18 is provided with a bottom opening 31 which is drilled and tapped to threadedly engage a machine bolt 32. As shown, the opening 31 is drilled through the plastic tubing 28 into the metal lining 29, and the drilled hole is tapped to provide a threaded receptacle 31 for the machine bolt 32. The upper end of the plastic pipe 25 is formed as a saddle with a hollow cylindrical end wall 33 adapted to seat flush against the outer cylindrical wall of the plastic pipe 28.

In accordance with the invention, an alignment stud 35 is anchored to the bottom of the rail to properly position the rail 18 on the top of the post 16 and to provide a firm interconnection in between. To this end, the anchor stud 35 comprises a hollow cylindrical element, preferably tubing formed of a soft metal such as an aluminum alloy. The stud is tubular and is of a short length and is formed at one end with a hollow cylindrical saddle 37 which is adapted to bear flush against the outer surface of the outer plastic pipe 28 of the handrail 18. The diameters of the hollow cylindrical surfaces forming the saddles 33 and 37 are equal to each other and to the outer diameter of the plastic pipe 28. The alignment stud 35 is held in place by the machine bolt 32 which passes through the through-bore in the hollow interior of the stud 35 to engage in the threaded aperture 31 in the bottom of the handrail. The stud 35 is tightened against the outer surface of the tubing 28 by tightening the bolt 32 against a washer 39 which bears against the lower end of the stud 35 so that when the bolt is tightened, the saddle end 37 of the stud snugly engages, and preferably embeds itself slightly into the outer cylindrical wall of the plastic pipe 28.

After the stud is in place, the upper end of the post 16 is telescopically engaged on the stud so that the saddle 33 formed at the upper end of the plastic sheath 25 of the post bears flush against the outer cylindrical wall of the handrail pipe 28. As shown in FIG. 2, after the post is in place with the saddle 33 bearing against the bottom segment of the handrail pipe 28, the pipe 25 is anchored to the stud 35 by a set screw 36 which penetrates through the pipe 25 through a countersunk hole 38. Following assembly and anchoring by the set screw 36, the countersunk hole 38 is plugged by a plug 40 set into the countersunk hole and glued in place. Preferably after assembly, the plug and the surrounding part of the plastic pipe 25 are sanded and polished to provide a similar surface texture which conceals the plug and renders the joint invisible.

Figure 5:
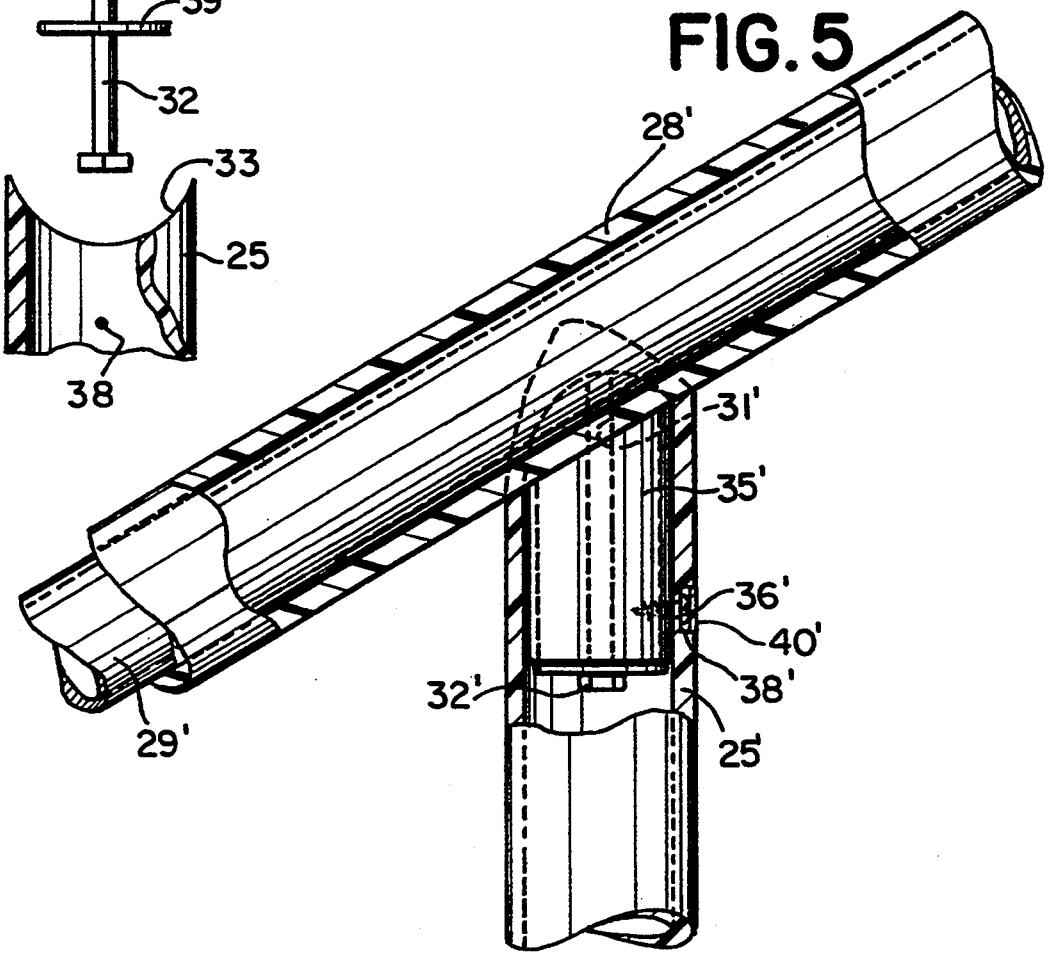
FIG. 5 is an elevational view with portions broken away illustrating the joint encircled at 5 in FIG. 1.

As shown in FIG. 5, the joint between the post and the inclined rail 18 encircled at 5 in FIG. 1, is substantially the same as the joint described above in connection with FIGS. 2–4. In FIG. 5, the corresponding parts of the joint are identified with the same reference numerals as applied in FIGS. 2–4 but with a prime. Thus, in FIG. 5 the top rail 18 is formed with a tubular plastic pipe 28' and a metallic liner 29'. The top of the post 16 is formed of a thick wall plastic pipe 25' and is adapted to be anchored onto the top rail by an alignment stud 35' secured to the top rail by a fastener 32' engaging a threaded opening 31' in the bottom of the top rail. The axis of the threaded opening 31' is at an angle determined by the slope of the pipe 28' relative to the horizontal when installed on the incline as shown in FIG. 1. Likewise, the saddles formed at the upper ends of the plastic pipe 25' and the alignment stud 35' are hollow cylinders formed on a cylindrical axis at an angle to the pipe and stud axes corresponding to the slope of the pipe 28' relative to the horizontal. The hollow cylindrical contour provided by the saddles engages flush against the bottom surface of the plastic pipe 28' when the handrail is inclined relative to the vertical post as shown in FIG. 5. Depending upon the incline of the rail 18, a centering insert (not shown) is mounted within the hollow stud 35' to center the elongated shank of the fastener 32' within the hollow bore of the stud 35'. It seats against the rail.

The vertical post 16 is anchored to the rail by securing the alignment stud 35' to the metal liner 29' of the inclined rail 18 by engaging through the drilled and tapped hole 31' which is drilled at an angle determined by the slope of the rail 18. The to aligner stud 35' is telescopically engaged in the plastic pipe 25' at the top of the rail and is secured in place by a set screw 36' which passes through a countersunk opening 38' in the plastic pipe 25'. The set screw is covered by a plug 40' and preferably the exposed surface of the plug and the surrounding surface of the plastic pipe 25' are sanded and polished so as to conceal the plug and render the joint invisible.

At the joint encircled at 6 in FIG. 1, between the auxiliary rail 19 and the vertical posts 16, the auxiliary rails 19 on opposite sides of the post are connected to the posts 16 by being anchored to the metallic liner 26 of the posts within the plastic pipe 25. It is noted that the auxiliary rails are anchored to the posts sufficiently below the upper terminal end of the posts 16 so as to be in registry with an area of the post which has the metallic liner 26 therein.

Figure 6:
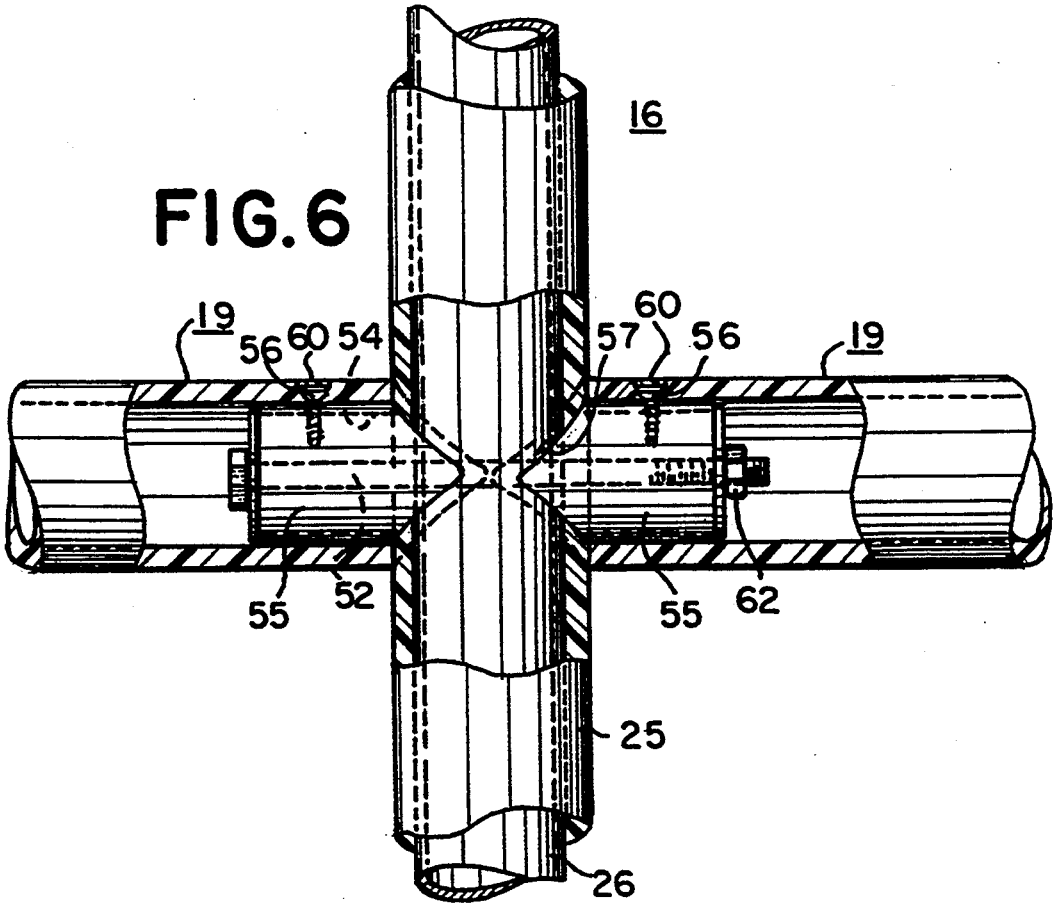
FIG. 6 is an elevational view with portions broken away illustrating the joint encircled at 6 in FIG. 1.
Figure 7:
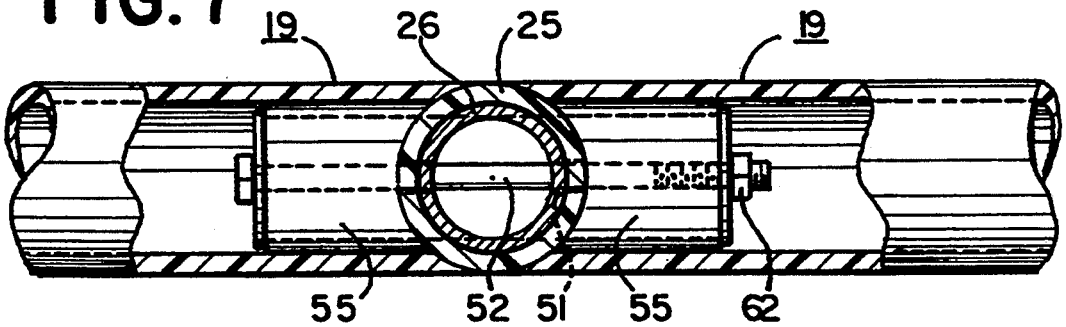
FIG. 7 is an irregular sectional view taken through the joint of FIG. 6.

The auxiliary rails 19 are mounted on the posts 16 by using aligner studs 55, which, like the studs 35, have a saddle 57 formed at one end by a hollow cylindrical surface whose cylindrical diameter is equal to the diameter of the plastic pipe 25 forming the outer skin of the post 16. Each aligner stud 55 is tubular in form to provide an interior passage or through-bore 54 through which a threaded fastener 52 passes. The post 16 is provided with apertures 51 through which the fastener may pass. Where the fastener passes entirely through the post as shown in FIGS. 6 and 7, the opening 51 in the post need not be tapped and should be slightly larger than the fastener 52 so as to afford free passage of the fastener through both aligner studs 55 and the post 16, including both the pipe 25 and the liner 26. A complementary threaded fastener 62 cooperates with the fastener 52 to clamp the aligner studs 55 tightly against the outer surface of the pipe 25. After installation of the studs 55, the auxiliary rails 19 are telescopically engaged on the studs, and a set screw 56 interlocks the plastic pipe of the auxiliary rail 19 with the aligner stud 55. In the present instance, the set screw is a self-tapping screw which is driven into the soft metal body of the stud 55 and is concealed by a cover plug 60.

In the case of the crossover between the posts 16 and the auxiliary rails 19 encircled at 6 in FIG. 1, the fastener 52 may serve a common purpose of anchoring both aligner plugs 55 to opposite sides of the post. Where the auxiliary rails are at different angles to the horizontal, separate aligner plugs are used on opposite sides of the post and each plug is anchored independently to the post by a separate fastener which threadedly engages the post, the openings in the post being drilled and threaded to accommodate the fastener at the desired angle. The auxiliary rails which are disposed at an angle are anchored by a stud whose saddle is formed at an angle, for example as shown in connection with the angled saddle of the stud 35' in FIG. 5.

The present inventions permits facile assembly of the railing at the job site. Preferably, the sections are fabricated to the specifications of the job site and shipped to the job site with the drilled and tapped openings 31, 31', 51, etc. appropriately made and the countersunk bores 38, 38', etc. also formed prior to shipment. The aligner studs are labeled for each location and positioning bolts may be engaged in the threaded openings of the posts and rails to prevent disalignment of the metal linings relative to the plastic pipe of the top rail 18 and post 16 during shipment. Normally the railing assembly is completed on a flat surface adjoining the installation site and then the assembly is mounted on the steps 13 and platform 14 using conventional mounting techniques appropriate to the character of the construction. Preferably the components are assembled in the desired arrangement and temporary strapping is provided to assure a tight fit of each saddle against its mating pipe prior to installation of the set screws. After installation of the set screws, the plugs are installed, ground and polished to provide a concealed interlock and a completely seamless assembly. Where the railing assembly extends for a considerable distance, the assembly is made in subassemblies of a length which can be readily handled and erected by the work force. The subassemblies may be connected together as they are erected.

The present invention facilitates repair and replacement of damaged components in the erected assembly, since the components are interconnected by a mechanical joint without cementing or welding the components of the joints together. Thus, if an auxiliary rail 19 is damaged, the damaged rail may be removed by cutting away the rail in the area of the set screw 56 at each end, removing the set screw and then the pipe from the alignment stud 55. The damaged rail 19 may then be discarded and a replacement rail may be installed over the studs. To enable telescopic engagement of the saddles at the end of the replacement rail with the studs 55, the rail is cut into two parts near the center of its span and each part is engaged and locked in place with set screws and the cut ends of the rail are spliced and welded. To complete the replacement process, the weld is sanded and polished so as to conceal the central weld in the rail. It should be noted that the joint of the present invention, although being mechanical rather than welded, provides a strong connection inasmuch as the full thickness of the plastic pipe telescopically engages over the aligner plug and seats flush against the outer surface of the plastic pipe to which it is joined. The formation of the joint does not require reduction of the full thickness of the plastic pipe and does not disturb the integrity of the plastic pipe to which it is joined. The assembly of the present invention avoids the use of preformed T-and X-fittings which not only are expensive, but also tend to fracture when stressed. As shown in FIG. 1, the plastic rail assembly of the present assembly simulates the aesthetic appearance of a welded tubular metal rail assembly which does not have any apparent joints or seams.

Figure 8:
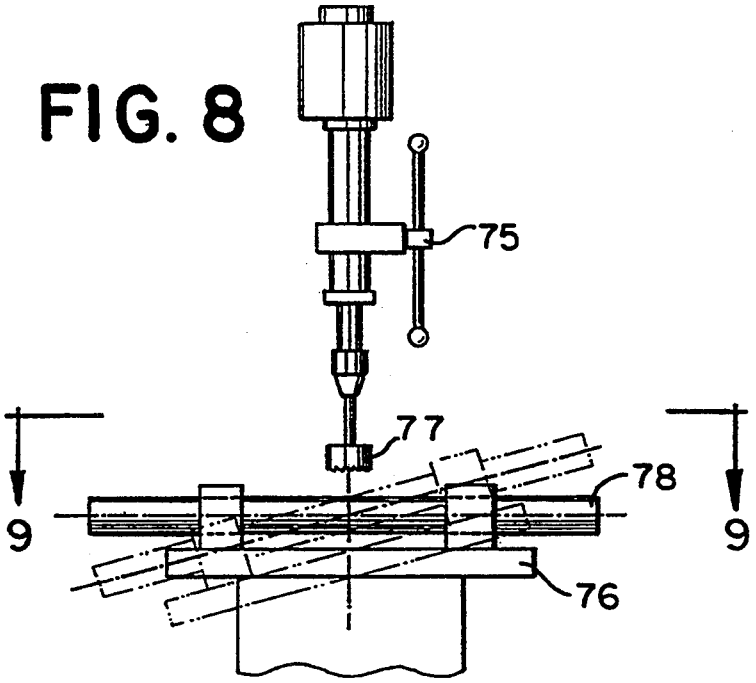
FIG. 8 is a view illustrating a preferred method of fabricating the handrail components of the handrail assembly.
Figure 9:
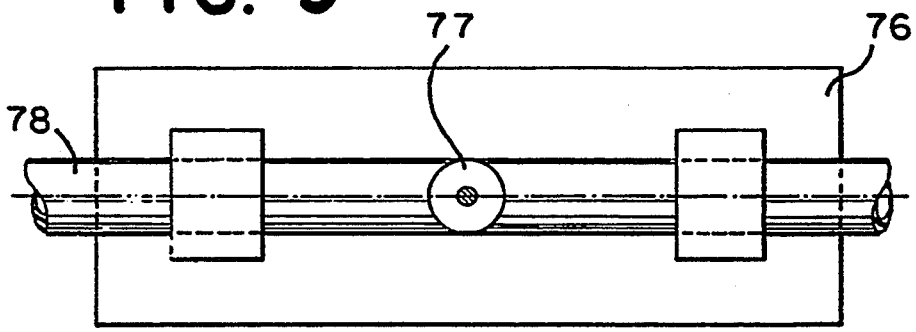
FIG. 9 is an enlarged sectional view taken on the line 9—9 of FIG. 8.
Figure 10:
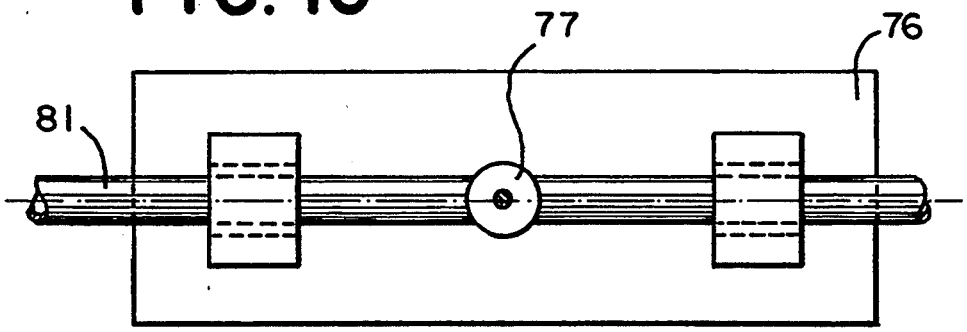
FIG. 10 is a view similar to FIG. 9 illustrating fabricating the alignment-stud components of the assembly.

FIGS. 8, 9 and 10 illustrate a preferred method for forming the saddles in the aligner studs and the ends of the plastic pipes. The saddles are formed using a conventional drill press 75 having an angularly adjustable table 76 for mounting the work. The drill press has a circular cutter element 77 which cuts out a cylindrical plug corresponding precisely to the cylindrical diameter of the plastic pipe to which the saddle is to be mounted. If the saddle is designed to mount the pipes at right angles, the table 76 is adjusted to be perpendicular to the path of travel of the cutter 77 so as to provide a cylindrical cut at right angles to the axis of the pipe 78. Cutting a cylindrical plug from the pipe 78 provides a cylindrical saddle in the remaining pipe on opposite sides of the plug. FIG. 9 illustrates that the saddle formed in the plastic pipe 78 provides a hollow cylindrical surface which extends through almost 160° of the circumference of the cylinder. FIG. 10 illustrates the formation of the saddle in the soft metal tube 81 which forms the alignment plugs 35, 35', 55, etc., whereas the plastic pipe 78 forms a saddle extending approximately 160° of cylindrical surface. The saddle formed in the tube 81 extends approximately 100° of the circumference of the cylindrical surface formed by the cutter 77. After forming the saddles in the components of the railing assembly, the components may be assembled and locked in place as described above.

The present invention is particularly suitable for installations where there is a need for railing along irregular terrain, where the slope of the railing in different sections must be custom designed to accommodate the terrain. In such instances, the present invention facilitates the installation of such a system by affording customized fabrication on-site using a portable drill to form the saddles and the drilled and tapped openings at angles selected to correspond to the slope of the terrain.

While particular embodiments of the present invention have been herein illustrated and described, it is not intended to limit the invention to such disclosure, but changes and modifications may be made therein and thereto within the scope of the following claims.

We claim:

1. A method of assembling a hand rail to a vertical post for use on an incline having a predetermined slope relative to the horizontal plane comprising the steps of:

providing two lengths of plastic pipe, a first length for use as the vertical post and a second length for use as the hand rail, said pipe having a bore and a thick wall;

providing an alignment stud having an outer circumference conforming to and slidable in the bore of said plastic pipe;

supporting one of said two lengths of pipe at an angle to the horizontal corresponding to said slope;

forming a saddle at one end of said one length of plastic pipe by cutting through said angularly supported pipe with a vertical pass of a cutting tool making a cylindrical cut having a radius corresponding to the outside radius of the other of said two lengths of pipe;

supporting said stud at an angle corresponding to said slope;

forming a saddle at one end of the stud by cutting the end of said stud with a vertical pass of a cutting tool making a cylindrical cut having a radius corresponding to the outside radius of the other of said two lengths;

assembling the saddle formed on said stud against the outside of the other of said two lengths of pipe and fastening said stud to said other length;

telescopically engaging said one length over said stud and engaging the saddle end of said one length against the outside of said other length;

driving a second fastener having a head through the wall of said one length of plastic pipe into said stud a distance to countersink the head within a recess in said one length of plastic pipe; and placing a plug in said recess to conceal the head.

2. A method of assembling a hand rail to a vertical post according to claim 1 wherein the one length having an end formed with a saddle is for use as a hand rail and said angle is equal to said predetermined slope of the incline.

3. A method of assembling a hand rail to a vertical post according to claim 1 wherein the one length having an end formed with a saddle is for use as a post and said angle is complementary to said predetermined slope of the incline.

4. A method of assembling a hand rail according to claim 1 including the steps of:

providing a metallic liner within the bore of said other of said two lengths of pipe, said liner conforming to the bore of said plastic pipe; and providing a fastener extending axially of said stud and projecting from the saddle formed in the stud;

said assembling step comprising causing the projecting fastener to penetrate through the thick wall of the plastic pipe of said other length and securing said fastener to said metallic liner.

5. A hand-rail assembly having a series of vertical posts, one top rail extending along the tops of said posts, an auxiliary rail positioned substantially parallel to said top rail between adjacent posts in said series, each of said posts and said rails comprising a selected length of plastic pipe with an inside radius forming a cylindrical bore, and an outside radius providing a predetermined wall thickness for the hollow cylindrical wall of said pipe, an alignment stud for joining one length of said selected lengths of pipe at a given angle to a second length of said selected lengths of pipe, said alignment stud having a cylindrical outside dimension fitted within the cylindrical bore of said one length, and having a through-bore, said stud having a saddle at one end formed by a hollow cylindrical surface conforming to the outside radius of said second length, the axis of said hollow cylindrical surface being at said given angle to the axis of the bore of said one length, said second length having a metallic liner within its bore where said second length joins said one length, a screw fastener extending through said through-bore, through the wall thickness of said second length, and into said metallic liner to anchor said stud on said second length with the saddle in flush engagement with the outside surface of said second length, the pipe of said one length having a hollow cylindrical saddle at its end matching the saddle of said stud, so that said matching saddle is in flush engagement with the outside surface of said second length of pipe, and a second fastener penetrating said wall of said one length and said stud to interlock said pipe with said stud.

6. A hand-rail assembly according to claim 5, wherein said alignment stud is formed of a soft metal capable of accepting a self-tapping set screw, and said wall of said one length having a countersunk wall recess, said second fastener being a self-tapping set screw having a head countersunk in said wall recess, said assembly including a plug fitted into said wall recess over said screw head to conceal the screw head.

7. A handrail assembly according to claim 6, wherein said plug is of the same composition as the plastic pipe, both the plug and the surrounding surface of the plastic pipe having a sanded and polished surface texture, so as to conceal the plug.

8. A hand-rail assembly according to claim 5 wherein said liner is formed of a hard metal, said liner having a socket drilled and tapped to mate with said threaded fastener.

9. A hand-rail assembly according to claim 8 wherein said threaded fastener comprises a machine bolt having a head with means to bear against the end of the stud which is opposite to the end formed as a saddle, and a threaded shank mating with said drilled and tapped socket.

10. A hand-rail assembly according to claim 8 wherein said one length is the vertical post of the assembly, and said second length is the top rail of the assembly, said socket being positioned in the underside of said top rail.

11. A hand-rail assembly having a series of vertical posts, one top rail extending along the tops of said posts, an auxiliary rail positioned substantially parallel to said top rail between adjacent posts in said series, said auxiliary rail comprising two individual lengths of pipe in axial registry with each other on opposite sides of a central vertical post, each of said posts and said rails comprising at least one selected length of plastic pipe with an inside radius forming a cylindrical bore, and an outside radius providing a predetermined wall thickness for the hollow cylindrical wall of said pipe, a pair of alignment studs, one for supporting each of said individual lengths at a given angle to the axis of said central post, each said alignment stud having a cylindrical outside dimension fitted within the cylindrical bore its associated length of pipe, and having a through-bore, said stud having a saddle at one end formed by a hollow cylindrical surface conforming to the outside radius of said post, the axis of said hollow cylindrical surface being at said given angle to the axis of the bore of said associated one length, said post having a metallic liner within the bore of its plastic pipe where said post supports said individual lengths, threaded fastener means extending through said through-bores of said pair of studs to anchor said studs on opposite sides of said post with their saddles in flush engagement with the outside radius of said post, the wall of said each of said individual lengths having a hollow cylindrical saddle at its end matching the saddle of said plug, so that said matching saddle is in flush engagement with the outside radius of said post, and second fastener means penetrating the walls of each of said individual lengths and said stud to interlock each of said lengths with its associated stud.

12. A handrail assembly according to claim 11, wherein said alignment stud is formed of a soft metal capable of accepting a self-tapping set screw, and said wall of said individual length having a countersunk wall recess, said second fastener means being a self-tapping set screw having a head countersunk in said wall recess, said assembly including a plug fitted into said wall recess over said screw head.

13. A hand rail assembly according to claim 12 wherein said plug is of the same composition as the plastic pipe, both the plug and the surrounding surface of the plastic pipe having a sanded and polished surface texture to conceal the plug.

14. A hand-rail assembly according to claim 11 wherein said registering individual lengths are in axial alignment, and said threaded fastener means comprises a single machine bolt having a head with means to bear against the end of one of said pair of studs which is opposite to the end formed as a saddle, a threaded shank extending through said through-bores and also through said post, and a complementary fastener mating with said threaded shank at its end opposite said head, and having means to bear against the end of the other of said pair of studs which is opposite to the end formed with a saddle.

15. A hand-rail assembly according to claim 14 wherein said liner is formed of a hard metal, said liner having a socket drilled to afford passage of the shank of said threaded fastener therethrough.

* * * * *